US009508497B2

(12) United States Patent
Kuhnle et al.

(10) Patent No.: US 9,508,497 B2
(45) Date of Patent: Nov. 29, 2016

(54) LOCKABLE ELECTRIC SWITCH

(75) Inventors: Axel Kuhnle, Freiberg A.N. (DE); Peter Schwenkel, Dettingen An der Erms (DE)

(73) Assignee: Robert Bosch GmbH, Stuttgart, DE (US)

( * ) Notice: Subject to any disclaimer, the term of this patent is extended or adjusted under 35 U.S.C. 154(b) by 734 days.

(21) Appl. No.: 13/995,619

(22) PCT Filed: Nov. 16, 2011

(86) PCT No.: PCT/EP2011/070288

§ 371 (c)(1),
(2), (4) Date: Sep. 11, 2013

(87) PCT Pub. No.: WO2012/084353

PCT Pub. Date: Jun. 28, 2012

(65) Prior Publication Data

US 2013/0341169 A1 Dec. 26, 2013

(30) Foreign Application Priority Data

Dec. 22, 2010 (DE) ..... 10 2010 063 962

(51) Int. Cl.
*B25D 17/04* (2006.01)
*H01H 9/06* (2006.01)
*H01H 11/00* (2006.01)

(52) U.S. Cl.
CPC ..... *H01H 9/06* (2013.01); *B25D 17/04* (2013.01); *H01H 11/0018* (2013.01)

(58) Field of Classification Search
CPC ..... B25D 17/04; B25D 17/24; B25F 5/00; H01H 9/266
USPC ..... 173/2, 48, 117, 216, 217, 201, 210; 200/61.58 R, 337; 310/47, 50; 388/937
See application file for complete search history.

(56) References Cited

U.S. PATENT DOCUMENTS 2,789,170 A * 4/1957 Johnson ..... H01H 9/063 200/321

(Continued)

FOREIGN PATENT DOCUMENTS

DE 35 38 680 A1 5/1987
DE 36 04 724 A1 8/1987

(Continued)

OTHER PUBLICATIONS

International Search Report corresponding to PCT Application No. PCT/EP2011/070288, mailed Feb. 15, 2012 (German and English language document) (7 pages).

*Primary Examiner* — Nathaniel Chukwurah
(74) *Attorney, Agent, or Firm* — Maginot, Moore & Beck LLP

(57) ABSTRACT

An electric switch, in particular for an electric power tool, in particular a hammer drill, comprises a first switching device and a second switching device, wherein the first switching device can be adjusted by adjusting a first mechanical signaling means from a first switched state to a second switched state, wherein the second switching device can be adjusted by adjusting a second electrical or mechanical signaling means from a third switched state in which the electric switch acts as a pushbutton into a fourth switched state in which the switch acts as a rocker switch. The disclosure further relates to an electrical power tool having an electric switch according to the disclosure.

15 Claims, 15 Drawing Sheets

(56) References Cited

U.S. PATENT DOCUMENTS

| | | | | |
|---|---|---|---|---|
| 4,879,438 | A * | 11/1989 | Winchester | H01H 9/06 200/505 |
| 6,766,868 | B2 * | 7/2004 | Frauhammer | B25D 16/006 173/162.2 |
| 7,398,834 | B2 * | 7/2008 | Jung | B25D 16/006 173/11 |
| 2006/0185865 | A1 * | 8/2006 | Jung | B25D 16/006 173/48 |
| 2009/0120658 | A1 * | 5/2009 | Kuhnle | B25D 17/04 173/211 |
| 2010/0018734 | A1 * | 1/2010 | Frauhammer | B25D 16/006 173/171 |

FOREIGN PATENT DOCUMENTS

| | | | |
|---|---|---|---|
| DE | 36 06 508 1 | | 9/1987 |
| DE | 36 22 003 | A1 | 1/1988 |
| DE | 100 34 768 | A1 | 2/2002 |
| DE | 10 2006 029 630 | A1 | 1/2008 |
| DE | 10 2008 041 511 | A1 | 3/2010 |
| WO | 2008/000543 | A1 | 1/2008 |

* cited by examiner

LOCKABLE ELECTRIC SWITCH

This application is a 35 U.S.C. §371 National Stage Application of PCT/EP2011/070288, filed on Nov. 16, 2011, which claims the benefit of priority to Serial No. DE 10 2010 063 962.1, filed on Dec. 22, 2010 in Germany, the disclosures of which are incorporated herein by reference in their entirety.

BACKGROUND

The present disclosure relates to an electric switch, in particular for an electric power tool, in particular a hammer drill or a chipping hammer, which electric switch comprises a first switching device and a second switching device, wherein the first switching device can be adjusted by means of adjusting a first mechanical signal means from a first switching mode into a second switching mode. The present disclosure further relates to an electric power tool having an electric switch in accordance with the disclosure.

It is known for electric power tools, in particular for hammer drills or chipping hammers, to damp vibrations in the hand grip by means of providing an elastic element between the hand grip and the tool housing of the electric power tool. Hand grips of this type are also described as anti-vibration hand grips. The elastic element enables the hand grip to move relative to the tool housing in a horizontal and/or vertical direction. An electric power tool having an elastic element of this type is disclosed in WO 2008/000543 A1.

DE 10 2008 041 511 A1 illustrates a handheld power tool that comprises an electric switch and a mechanical adjusting device that is arranged on the electric switch and is embodied in this case as a rocker switch. The electric switch can be actuated by means of the rocker switch. The rocker switch can be locked in an operating mode of the machine by means of a locking device. In the case of hammer drills, in order to increase the level of comfort for the user, the rocker switch is for example frequently locked in the "chipping operation", so that the operator does not need to constantly hold down the switch in this operating mode. However, the rocker switch cannot be locked in the "drilling" or "hammer drill operation", so that the electric power tool can be switched off as quickly as possible by the operator in the event of the drill tilting and said drill cannot rotate in an uncontrolled manner and consequently it cannot therefore injure the operator.

However, it is extremely difficult to implement the locking function in the case of anti-vibration hand grips since an operating mode switch is conventionally arranged on the tool housing and a relative movement of several millimeters can occur between the hand grip housing and the tool housing. In addition, a locking of this type requires a mechanical deflection between the operating mode switch and the locking action of the rocker switch. Furthermore, an on/off switch of this type requires a considerable amount of installation space and the higher the power rating of the electric power tool, the greater the installation space.

DE 100 34 768 A1 discloses for example a high-performance hammer drill, wherein the operating mode switch is rigidly coupled to a locking device for a switching latch. However, this rigid coupling arrangement does not allow the hand grip housing to be fully decoupled from the tool housing with regard to the vibrations of a tool housing of the electric power tool. In addition, the lever mechanism required for coupling the locking device to the operating mode switch requires considerable installation space. Furthermore, the locking device is also not dustproof.

SUMMARY

The object of the present disclosure is to provide a particularly high-performance electric power tool that is operated in at least one operating mode without an actuating means for driving the electric power tool having to be permanently actuated, wherein the hand grip can be embodied as an anti-vibration hand grip that can be fully decoupled from the tool housing, and wherein the hand grip is embodied in an extremely compact and stable manner. A further object of the disclosure is to improve the level of protection to prevent dust penetrating into the anti-vibration device.

The object is achieved by means of an electric switch, in particular for an electric power tool, in particular a hammer drill or a chipping hammer, which electric switch comprises a first switching device and a second switching device, wherein the first switching device can be reversibly adjusted by means of adjusting a first mechanical signal means from a first switching mode into a second switching mode, wherein the second switching device can be reversibly adjusted by means of adjusting a second electric or mechanical signal means from a third switching mode in which the electric switch functions as a push button into a fourth switching mode in which said electric switch functions as a rocker switch.

In the case of a push button in terms of the disclosure, the electric switch returns automatically from the second switching mode into the first switching mode. It is preferred in this case that the electric switch is adjusted against the restoring force of a first force means from the first switching mode into the second switching mode, so that said electric switch is automatically returned to its previous position by means of the restoring force of the first force means.

In the case of a rocker switch in terms of the disclosure, the electric switch does not automatically return from the second switching mode into the first switching mode but rather remains in the second switching mode.

It is therefore preferred that the switch in accordance with the disclosure in the fourth switching mode, in which it functions as a rocker switch, is either locked or at least can be locked. In the framework of FIGS. 1-6, the fourth switching mode is therefore described as the locked mode.

The electric switch can therefore itself be locked or is locked. In comparison to a conventional device, in which a mechanical adjusting device for actuating a conventional electric switch can be locked by means of a separate locking device, an electric switch in accordance with the disclosure can be constructed in a considerably more compact manner and thus renders it possible for it to be positioned in a considerably less restrictive manner in an electric power tool and by reason of less installation space being required a compact embodiment of the electric power tool is achieved.

It is preferred that the second switching mode is a switched-on mode in which the electric switch closes a current circuit, in particular a motor current circuit for driving the electric power tool and that the first switching mode is a switched-off mode in which the current circuit is open. Depending upon the particular application, an embodiment is however also preferred in which the first switching mode is the switched-on mode and the second switching mode is the switched-off mode, so that the electric switch automatically returns from the switched-off mode into the switched-on mode.

It is further preferred that the electric switch is adjusted against the restoring force of a second force means from the third switching mode into the locked mode, so that said electric switch is returned by means of the restoring force of the second force means from the locked mode into the third switching mode. Depending upon the particular application, an embodiment is however also preferred in which the electric switch is adjusted against the restoring force of the second force means from the locked mode into the third switching mode, so that said electric switch is returned by means of the restoring force of the second force means from the third switching mode into the locked mode.

In a particularly preferred embodiment, the electric switch is adjusted against the restoring force of the second force means from the third switching mode into the locked mode, wherein said electric switch is adjusted against the force of the first force means from the switched-off mode into the switched-on mode. In this preferred embodiment, the third switching mode is an initial mode of the electric switch and the electric switch for example can be used as a motor switch for driving the electric power tool.

It is preferred that the first switching device comprises an electrical contact and electrical connections for closing the current circuit. The electrical contact is preferably provided in order not to connect the electrical connections in the switched-off mode so that the current circuit is open, and in order to connect the electrical connections in the switched-on mode so that the current circuit is closed.

It is further preferred that the electric switch comprises a housing. In this case, it is particularly preferred that only the first and second signal means and the electric connections are arranged partially outside the housing so that they are accessible from the outside. As a consequence, the switch is protected against external influences, for example, to prevent the penetration of dust and moisture. In an advantageous manner, the switch of this embodiment can be manufactured as a single-module component so that it can be mounted in a cost-effective manner and can be used for electric power tools of different types.

In a preferred embodiment, the first switching device comprises also a first adjusting means that cooperates with the first signal means, wherein the electrical contact can be adjusted by means of the first adjusting means. As the first signal means is adjusted, the first adjusting means is adjusted, so that the electrical contact is adjusted from the switched-off mode into the switched-on mode and the reverse. The first switching means is preferably provided as a sliding means or as a rotating means.

In a further preferred embodiment, the second switching device comprises a second adjusting means that cooperates with the second signal means, wherein the first signal means and/or the first adjusting means can be locked or are locked in the locked mode by means of the second adjusting means. As the second signal means is adjusted, the second adjusting means is therefore preferably adjusted in such a manner that it prevents the movement of the first signal means and/or of the first adjusting means. The second adjusting means is likewise preferably embodied as a sliding means or as a rotating means.

In this preferred embodiment, the first signal means and/or the first adjusting means can be locked in the switched-off mode and are locked in the switched-on mode by means of adjusting the second adjusting means.

Furthermore, in this preferred embodiment, the first signal means and/or the first adjusting means cannot be locked or are not locked in the initial mode by means of the second adjusting means. The electric switch in this embodiment therefore only remains in the locked mode in the switched-on mode. In every other mode, said electric switch is located either in the switched-off mode or it returns automatically to the switched-off mode. It is therefore necessary for the operator to purposefully adjust the switch in order to remain in the switched-on mode. This embodiment ensures the maximum possible reliability concerning the prevention of the current circuit being unintentionally switched on.

The first signal means can preferably be actuated by means of a first actuating means and the second signal means can likewise preferably be actuated by means of a second actuating means. The first and the second signal means therefore represent the interface, by means of which the electric switch can be actuated and switched between its different switching modes.

In a preferred embodiment, the first signal means and/or the first adjusting means and/or the first actuating means are embodied in a mechanical manner. In this embodiment, the first signal means can preferably be actuated by means of the first actuating means, it can in particular be rotated or displaced, wherein the first adjusting means can be adjusted by means of the first signal means from the switched-off position into the switched-on position or the reverse, it can in particular be rotated or displaced. It is particularly preferred that the first signal means is embodied as an angled lever, wherein the first adjusting means is preferably embodied as a sliding means, and wherein the first actuating means is preferably embodied as a rocker switch. The angled lever can then be actuated preferably by means of the rocker switch, in particular said angled lever can be rotated, wherein the sliding means can be displaced by means of the angled lever from the switched-off position into the switched-on position or the reverse.

The rocker switch is preferably rotatably mounted on the switch housing of the electric switch. In this embodiment, the rocker switch preferably comprises a first rocker switch part and a second rocker switch part, wherein the electric switch can be adjusted by means of actuating the first rocker switch part into the switched-on mode and by actuating the second rocker switch part into the switched-off mode.

In a further preferred embodiment, the second signal means and/or the second adjusting means and/or the second actuating means are provided in a mechanical manner. In this embodiment, the second signal means can be preferably actuated by means of the second actuating means, it can in particular be rotated or displaced, wherein the second adjusting means can be adjusted by means of the second signal means from the switched-off position into the switched-on position or the reverse, it can in particular be rotated or displaced. It is particularly preferred that the second signal means is embodied as a switching lever, wherein the second adjusting means is preferably embodied as a locking latch, and wherein the second actuating means is preferably embodied as a switching connection, in particular as a pulling means or as a Bowden cable. The switching lever can then be actuated preferably by means of the switching connection; it can in particular be rotated, wherein the locking latch can be rotated by means of the angled lever from the initial position into the locked position or the reverse.

The locking latch is preferably mounted on the switching lever and in the locked mode cooperates with the sliding means. For this purpose, the sliding means likewise preferably comprises a blocking means that in the locked mode lies against the locking latch, so that the sliding means is locked in the switched-on mode and can no longer be displaced. As a consequence, it is not possible for the sliding means, and consequently also the angled lever to automatically return to the initial position by means of the restoring force of the first force means.

It is likewise preferred that the second signal means and/or the second adjusting means and/or the second actuating means are provided in an electric, electronic or electromagnetic manner. The second signal means is then preferably a Tipp-signal that is triggered, for example, by means of being keyed again or by means of a another signal being triggered by the operator, in particular an operating mode switch of the electric power tool, which operating mode switch is embodied, for example, in an electric manner. In this embodiment, the second adjusting means is preferably likewise adjusted electrically, for example with the aid of a relay.

Fundamentally, an embodiment is also possible in which the first signal means and/or the first adjusting means and/or the first actuating means are provided in an electric manner.

The object is further achieved by means of an electric power tool, in particular a hammer drill or a chipping hammer having an electric switch in accordance with the disclosure.

Since the electric switch in accordance with the disclosure can be produced in a considerably compact manner irrespective of the power rating of the electric power tool, there is either more available installation space in the electric power tool or said electric power tool can likewise be constructed in a more compact manner.

In a preferred embodiment, the electric switch and the first actuating means are arranged in a hand grip housing, in particular in an anti-vibration hand grip housing, wherein the electric power tool comprises an operating mode switch for adjusting the second actuating means, which means is arranged in a tool housing.

In this embodiment, the hand grip housing of the electric power tool can be produced in a more compact manner so that the electric power tool can be handled in a simpler manner.

BRIEF DESCRIPTION OF THE DRAWINGS

Hereinunder, the disclosure is described with reference to the figures. The figures are only examples and do not limit the general concept of the disclosure.

DETAILED DESCRIPTION

Figure 1:
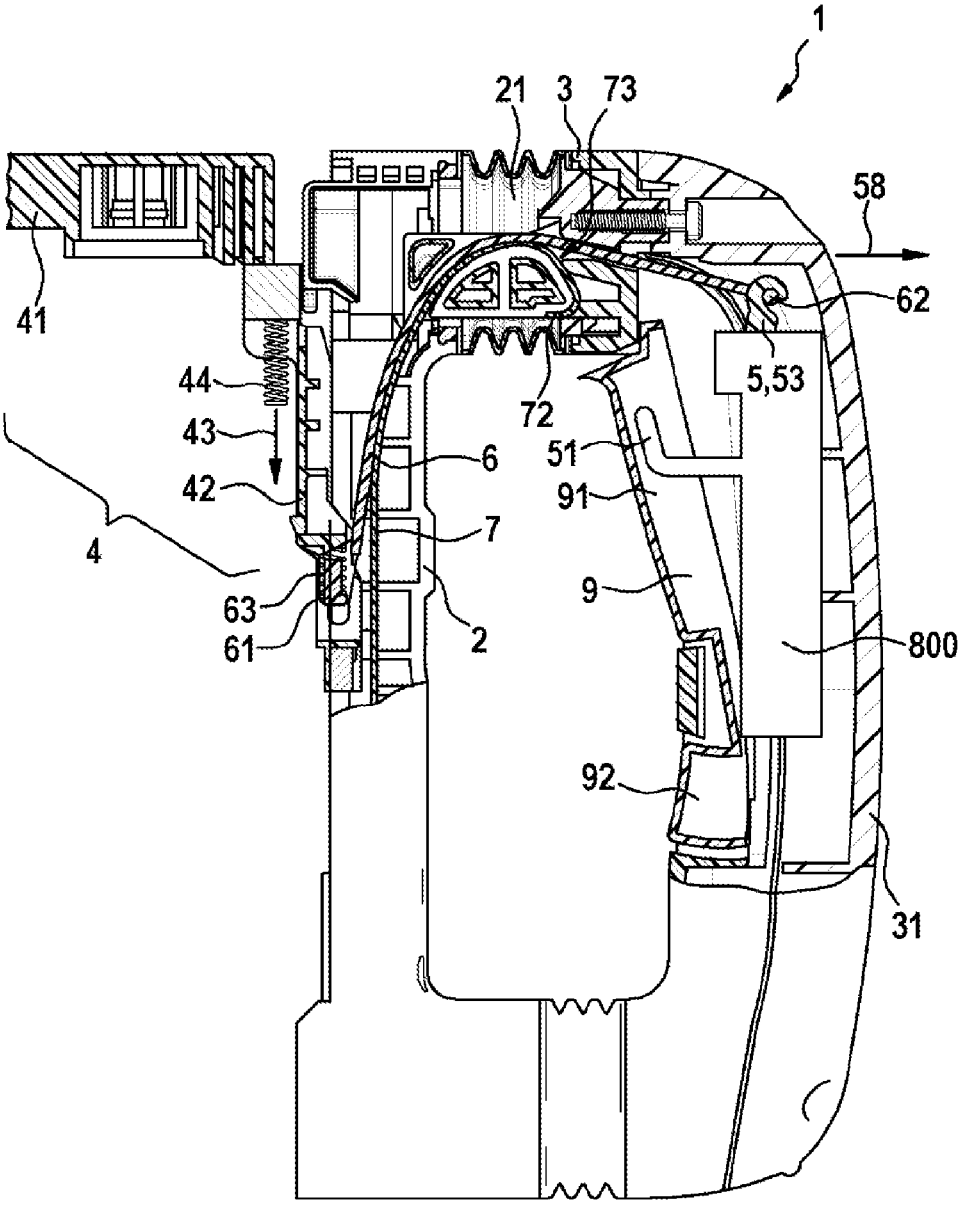
FIG. 1 illustrates an electric power tool having a hand grip housing that is embodied as an anti-vibration hand grip housing, wherein the electric power tool comprises an electric switch in accordance with the disclosure.

FIG. 1 illustrates an electric power tool 1 in accordance with the disclosure having a hand grip housing 3 that is embodied as an anti-vibration hand grip housing.

The hand grip housing 3 is supported on a tool housing 2 by means of a leaf spring 7. In this case, the leaf spring 7 comprises a first end (not visible) and a second end 72, wherein the leaf spring is fixedly connected by means of its first end to the tool housing 2. At the second end 72 of the leaf spring 7, the hand grip housing 3 is supported on the upper face 73 of said leaf spring, so that the hand grip housing 3 can move in a resilient manner in the horizontal and the vertical direction. As a consequence, it is possible for a relative movement of several millimeters to occur between the tool housing 2 and the hand grip housing 3. A bellows element 21 is provided between the tool housing 2 and the hand grip housing 3, so that this relative movement between the tool housing 2 and the hand grip housing 3 is possible without damaging the tool housing 2 or the hand grip housing 3.

A recessed grip molding 31 can be releasably attached to the hand grip housing 3, so that machine components that are arranged in the hand grip housing 3 can be accessed from outside.

The electric power tool 1 of this exemplary embodiment is a hammer drill that can be adjusted by means of an operating mode switch 41 into the operating modes: "drilling", "hammer drilling" and "chipping". Within the framework of FIGS. 1-6, the terms "electric power tool 1" and "hammer drill" are used synonymously. A slider 42 can be displaced by means of the operating mode switch 41 in a displacement direction 43 or in the opposite direction thereto, wherein the slider 42 is displaced against the force of a compression spring 44 that is supported on the tool housing 2.

A first end 61 of a second actuating means 6 that is embodied in this case as a band is fixed on the slider 42. Within the framework of FIGS. 1-6, the terms "second actuating means 6" and "band" are used synonymously. In the present exemplary embodiment, the first end 61 is retained on account of the prestressing of the spring 63. However, embodiments are also preferred in which the band 6 is fixedly connected to the slider 42, for example by means of a screw or clip connection. As an alternative, in this case it is also possible to provide a Bowden cable (not illustrated) in place of the band 6.

A second end 62 of the band 6 is fixed to a hook 531 of a second signal means 53 of a second switching device 5 (cf. FIGS. 3-6) of an electric switch 800, so that the operating mode switch 41 is connected by way of the band 6 directly to the second signal means 53. The second signal means 53 is in this case embodied as a switching lever. Within the framework of FIGS. 1-6, the terms "second signal means 53" and "switching lever" are used synonymously; and in fact, the second end 62 in this case is retained in the hook 531. It is, however, also preferred that the second end 62 is fixedly connected to the second switching device 5.

The operating mode switch 41 is therefore connected by way of the band 6 in a mechanical manner to the second switching device 5.

A first actuating means 9 that is embodied in this case as a rocker switch is arranged on the electric switch 800. Within the framework of FIGS. 1-6, the terms "first actuating means 9" and "rocker switch" are used synonymously. The rocker switch 9 is rotatably mounted on the switch housing of the electric switch 800. Said rocker switch comprises a first rocker switch part 91 and a second rocker switch part 92. A first switching device 8 of the electric switch 800 can be adjusted by means of actuating the first rocker switch part 91 from a first switching mode A into a second switching mode E. In the present exemplary embodiment, the electric switch 800 is embodied as an operating switch of the electric power tool 1. Within the framework of FIGS. 1-6, the terms "electric switch 800" and "operating switch" are therefore used synonymously.

Since the electric switch 800 in this case is the operating switch of the electric power tool 1, the first switching mode A in this case is provided as a switched-off mode in which the electric power tool 1 is switched off, wherein the second switching mode E is a switched-on mode E in which the electric power tool 1 is switched on. Within the framework of FIGS. 1-6, the terms "first switching mode A" and "switched-off mode" and also "second switching mode E" and "switched-on mode" are used synonymously.

As the operating mode switch 41 is adjusted from the "drilling operation" or from the "hammer drill operation" into the operating mode "chipping operation", the slider 42 is displaced in the displacement direction 43 by means of a cam contour (not illustrated) of the operating mode switch 41. As a consequence, the slider 42 pulls on the band 6, so that the second switching device 5 is adjusted from a third switching mode G against a restoring force, which is represented in this case by an arrow 58, by means of the switching lever 53 into a fourth switching mode AR.

An operating switch 800 of a hammer drill 1 cannot be locked in the "drilling operation" or "hammer drill operation", consequently said hammer drill does not continue to rotate in an uncontrolled manner as the drill tilts, so that the operator of the hammer drill is protected. The operating switch 800 must therefore be embodied as a matter of necessity as a push button in the "drilling operation" or "hammer drill operation". In contrast thereto, it is preferred in the "chipping operation" that the operating switch 800 can be locked. It is therefore preferred in this operating mode that the operating switch 800 functions as a rocker switch.

The operating switch 800 is therefore provided in this case in such a manner that the third switching mode G is an initial mode in which the operating switch 800 cannot be locked or is not locked and which switching mode is set if the hammer drill 1 is located in the "drilling operation" or the "hammer drill operation". Furthermore, the operating switch 800 is provided in this case in such a manner that the fourth switching mode AR is a locked mode in which the operating switch 800 can be locked or is locked and which fourth switching mode is set if the hammer drill 1 is located in the "chipping operation". Within the scope of FIGS. 1-6, the terms "third switching mode G" and "initial mode" and also "fourth switching mode AR" and "locked mode" are therefore used synonymously.

In the case of a depressed first rocker switch part 91, the operating switch 800 is consequently locked in the locked mode, if the hammer drill 1 is switched on. The operating switch 800 can in fact then be adjusted by means of depressing the second rocker switch part 92 from the switched-on mode E into the switched-off mode A, wherein the hammer drill 1 is switched off. However, the operating switch 800 remains then in the locked mode AR so that it can still be locked.

As the operating mode switch 41 is returned from the operating mode "chipping operation" into the "drilling operation" or into the "hammer drill operation" the slider 42 is displaced with the aid of the compression spring 44 in the opposite direction to the displacement direction 43. Since the band 6 is of fixed length, said band follows the sliding movement of the slider 42, so that the hook 531 is returned to its previous position, wherein the second switching device 5 is returned to its previous position, so that the operating switch 800 is returned from the locked position AR into the initial position G. In this case, the second switching device 5 is returned by means of the restoring force 58 into the initial position G.

The operating switch 800 and the rocker switch 9 are accessible from the outside by means of releasing and removing the recessed grip molding 31.

Figure 2A:
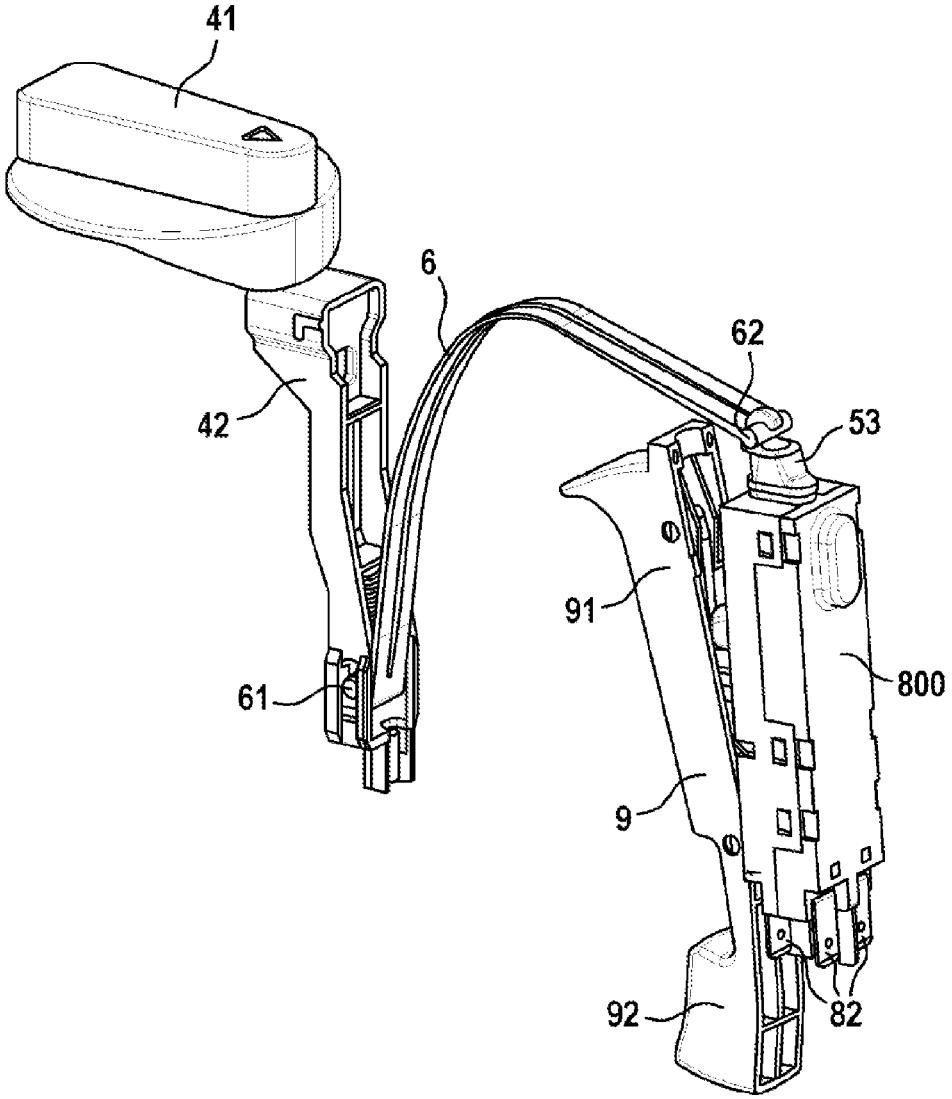
FIG. 2 illustrates a section of the electric power tool shown in FIG. 1 and in fact (a) is a perspective view and (b) is a lateral sectional view.
Figure 2B:
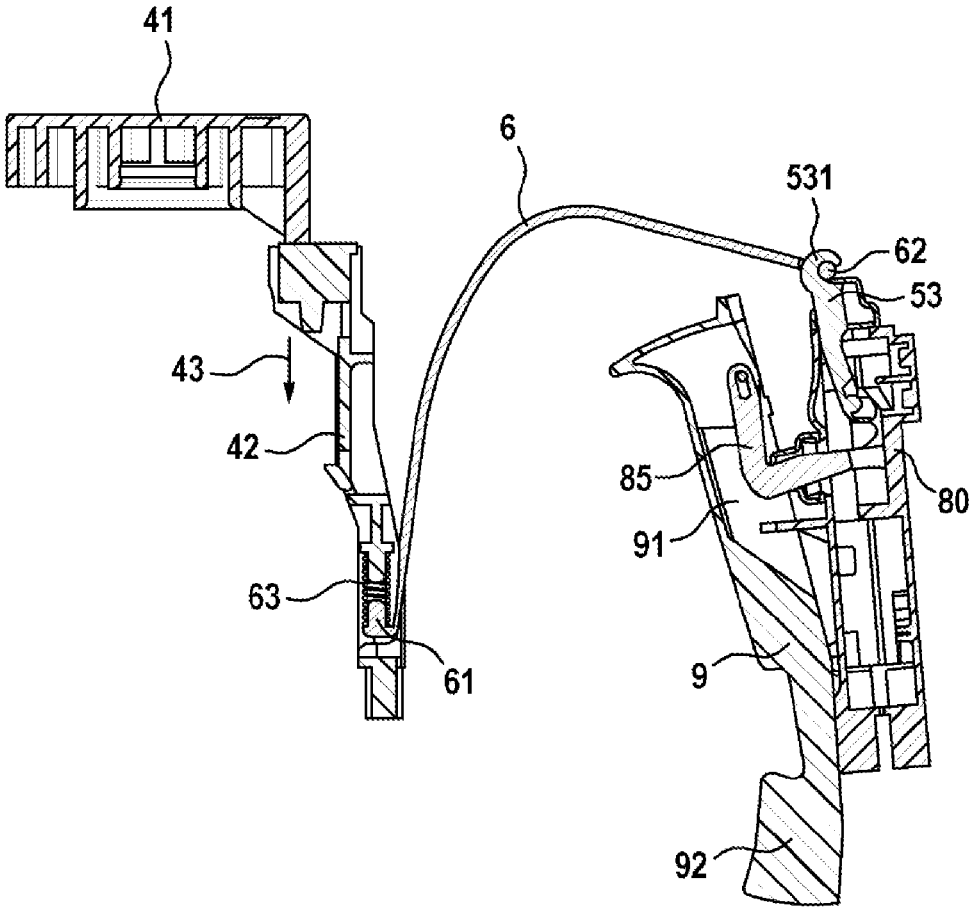

FIG. 2 illustrates a section of the electric power tool 1 shown in FIG. 1 and in fact in (a) in a perspective view and in (b) in a lateral sectional view. FIG. 2 illustrates that connections 82 for connecting a current circuit (not illustrated), in this case the motor current circuit, are provided on the operating switch 800. The connections 82 are provided at least partially outside a switch housing 80 of the operating switch 800. In addition, it is also evident in this case that the switching lever 53 and a first signal means 85 that is embodied in this case as an angled lever and cooperates with the rocker switch 9, are likewise provided at least partially outside the housing 80, so that they are accessible from the outside. The operating switch 800 is, however, moreover arranged inside the switch housing 80 and consequently protected from dust and moisture. In addition, the electric switch 800 of this embodiment can be used as a modular component in a multiplicity of different electric power tools 1. And finally, it is easy to handle a component that is protected by means of a switch housing 80.

Within the framework of FIGS. 2-6, the terms "first signal means 85" and "angled lever" are used synonymously.

Figure 3A:
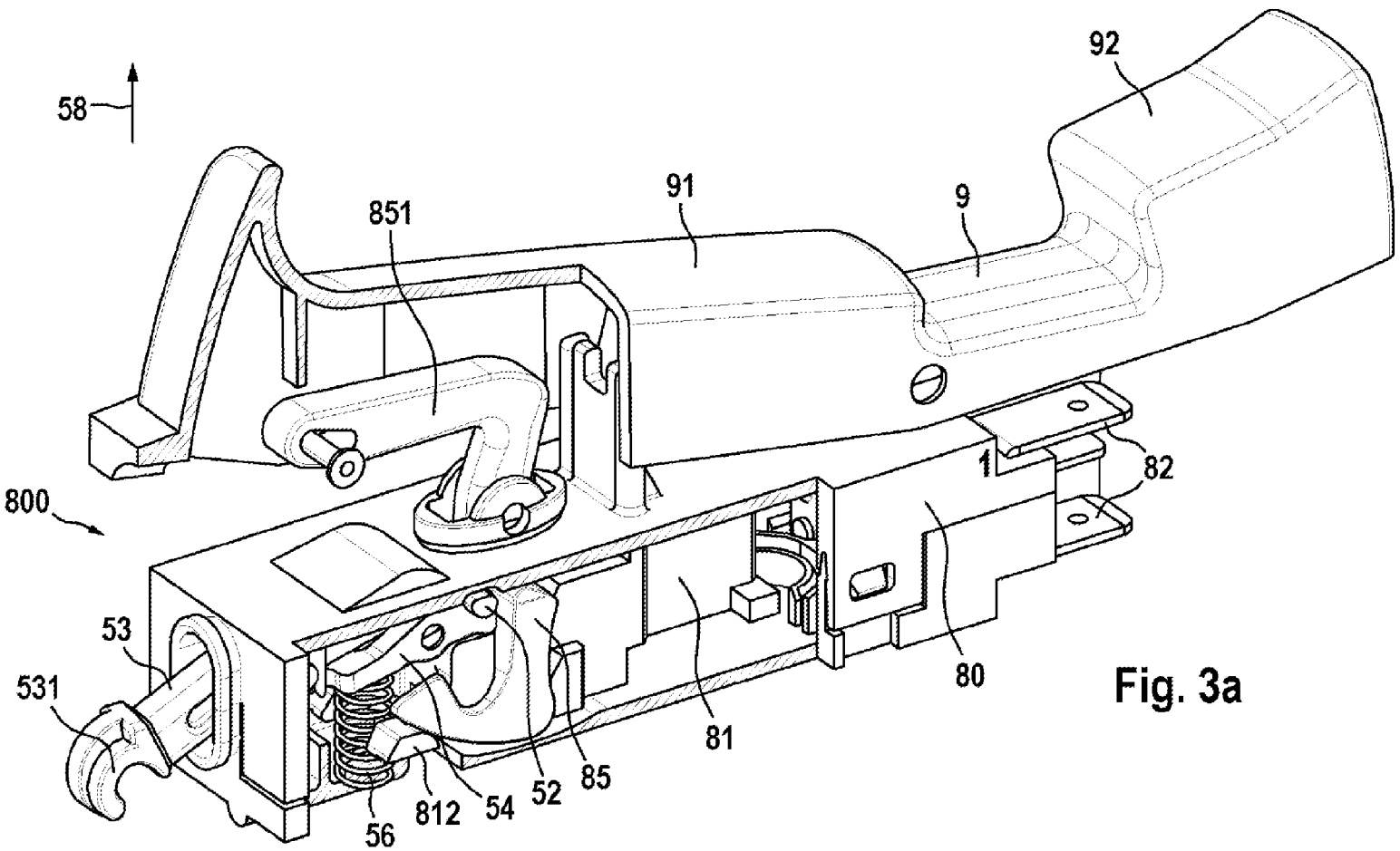
FIG. 3 illustrates in FIGS. 3 (*a*)-(*c*) the electric switch in accordance with the disclosure of the electric power tool shown in FIG. 1, wherein the electric switch comprises a first switching device and a second switching device, and where the first switching device is located in the switched-off mode and the second switching device is located in the initial mode.
Figure 3B:
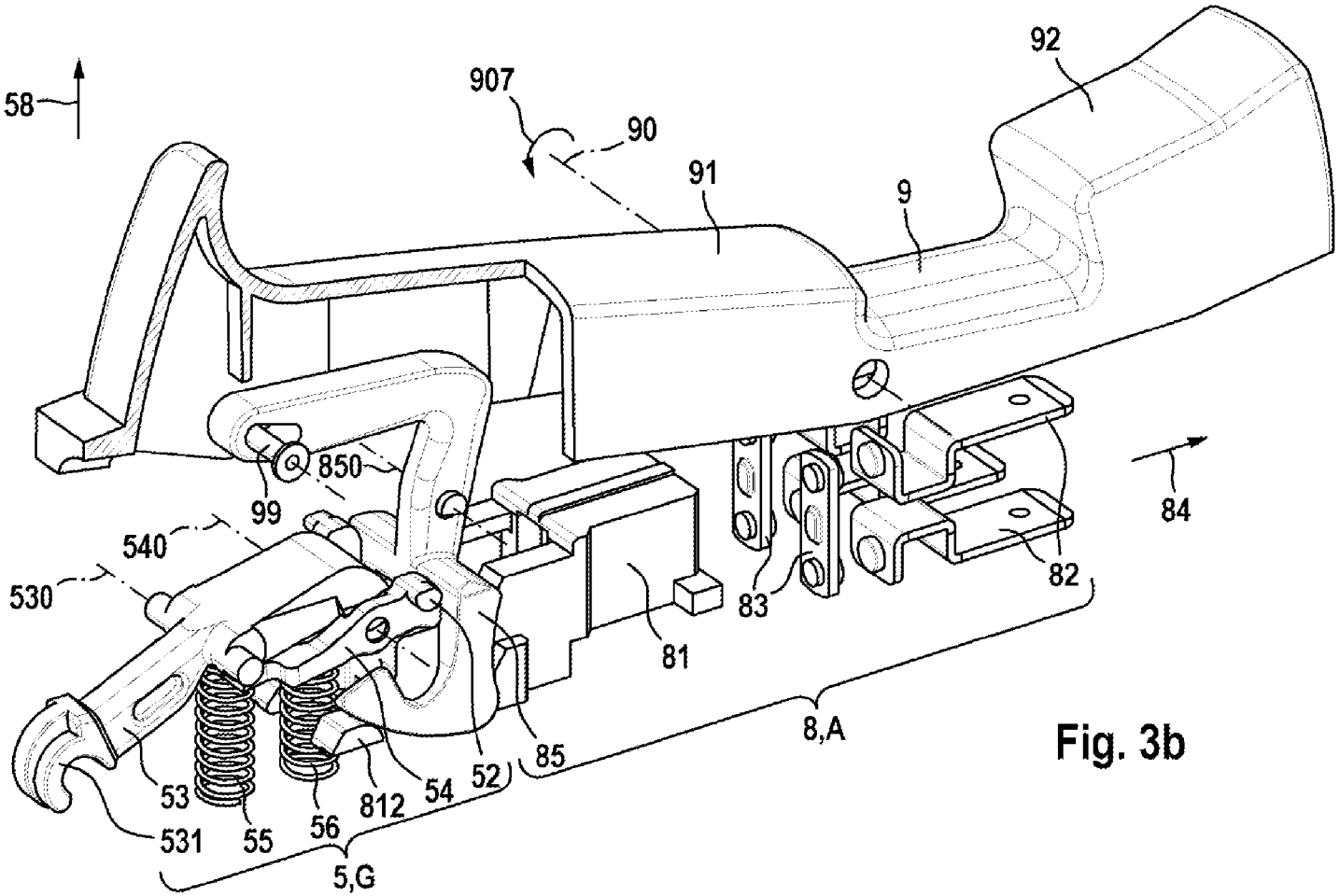
Figure 3C:
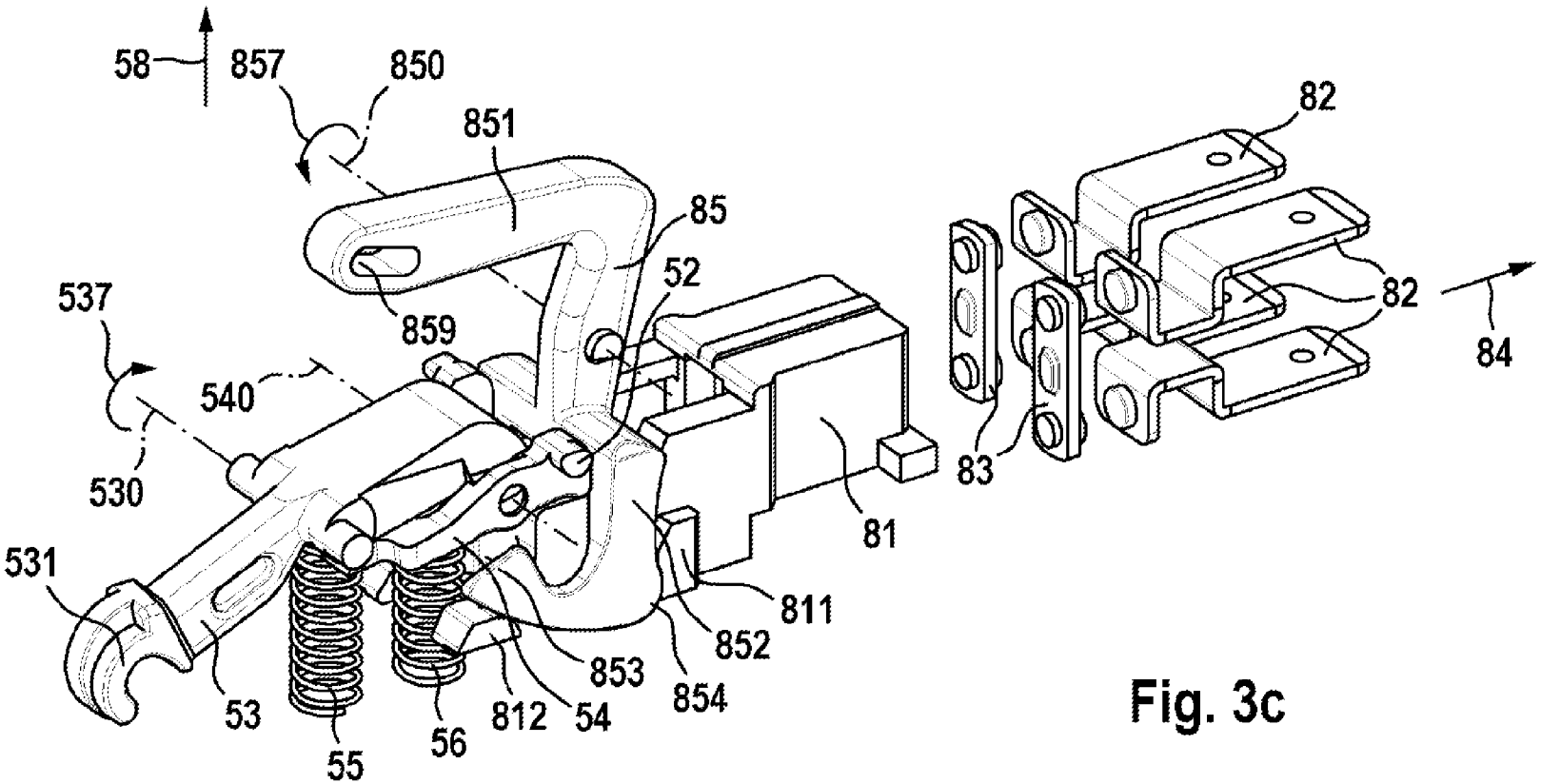

FIG. 3 illustrates in FIGS. 3 (*a*)-(*c*) the operating switch 800 of the hammer drill 1 shown in FIG. 1 and the rocker switch 9, wherein the first switching device 8 of the operating switch 800 is located in the switched-off mode A and the second switching device 5 is located in the initial mode G.

The first switching device 8 comprises in this case two electrical contacts 83 and electrical connections 82 for closing the motor current circuit. Furthermore, said first switching device comprises a first adjusting means 81 that cooperates with the angled lever 85.

The angled lever 85 that is mounted on the switch housing 80 of the operating switch 800 can rotate about an angled lever axis 850 by means of actuating the rocker switch 9. For this purpose, said angled lever comprises an end 851, which faces a rocker switch 9, and an end 852, which faces the operating switch 800. A fastening means 859 is provided on the end 851 of said angled lever that faces the rocker switch 9 and the rocker switch 9 can be attached to said fastening means in a rotatable manner. The fastening means 859 is embodied in this case as an elongated hole, wherein a counter-fastening means 99 is provided on the rocker switch 9, which counter-fastening means is embodied in this case as a connecting pin that is arranged on the rocker switch 9. Fundamentally, however, it is also possible to provide a different rotating or sliding connection.

The angled lever 85 is embodied in a similar manner to an arcuate extension on its end 852 that faces the operating switch 800. The end 852 of the angled lever, which end is embodied in a similar manner to an arcuate extension and faces the operating switch 800, is described within the framework of FIGS. 3-6 as an arcuate extension. The arcuate extension 852 comprises an end 853 that faces the second switching device 5 and also comprises an end 854 that is remote from the second switching device 5. The end 854 that is remote from the second switching device 5 lies against a contacting means 811 of the first adjusting means 81. The first adjusting means 81 is embodied in this case as a sliding means. Within the framework of FIGS. 3-6, the terms "first adjusting means 81" and "sliding means" are used synonymously. The first adjusting means 81 can, however, also be embodied as a rotating means in place of a sliding means.

The sliding means 81 can be displaced against the force of a first force means (not illustrated).

The rocker switch 9 is rotated about a rocker switch axis 90 in an actuating direction 907 by means of actuating the first rocker switch part 91. In this case, the angled lever 85 is rotated about the angled lever axis 850 in an angled lever direction 857. As a consequence, the sliding means 81 is displaced in the sliding direction 84, wherein the electrical contacts 83 are likewise displaced in the sliding direction 84, until said electrical contacts lie against the electrical connections 82 and connect said electrical connections, so that the motor current circuit is closed. As a consequence, the operating switch 800 is adjusted from the switched-off position A into the switched-on position E.

Figure 4A:
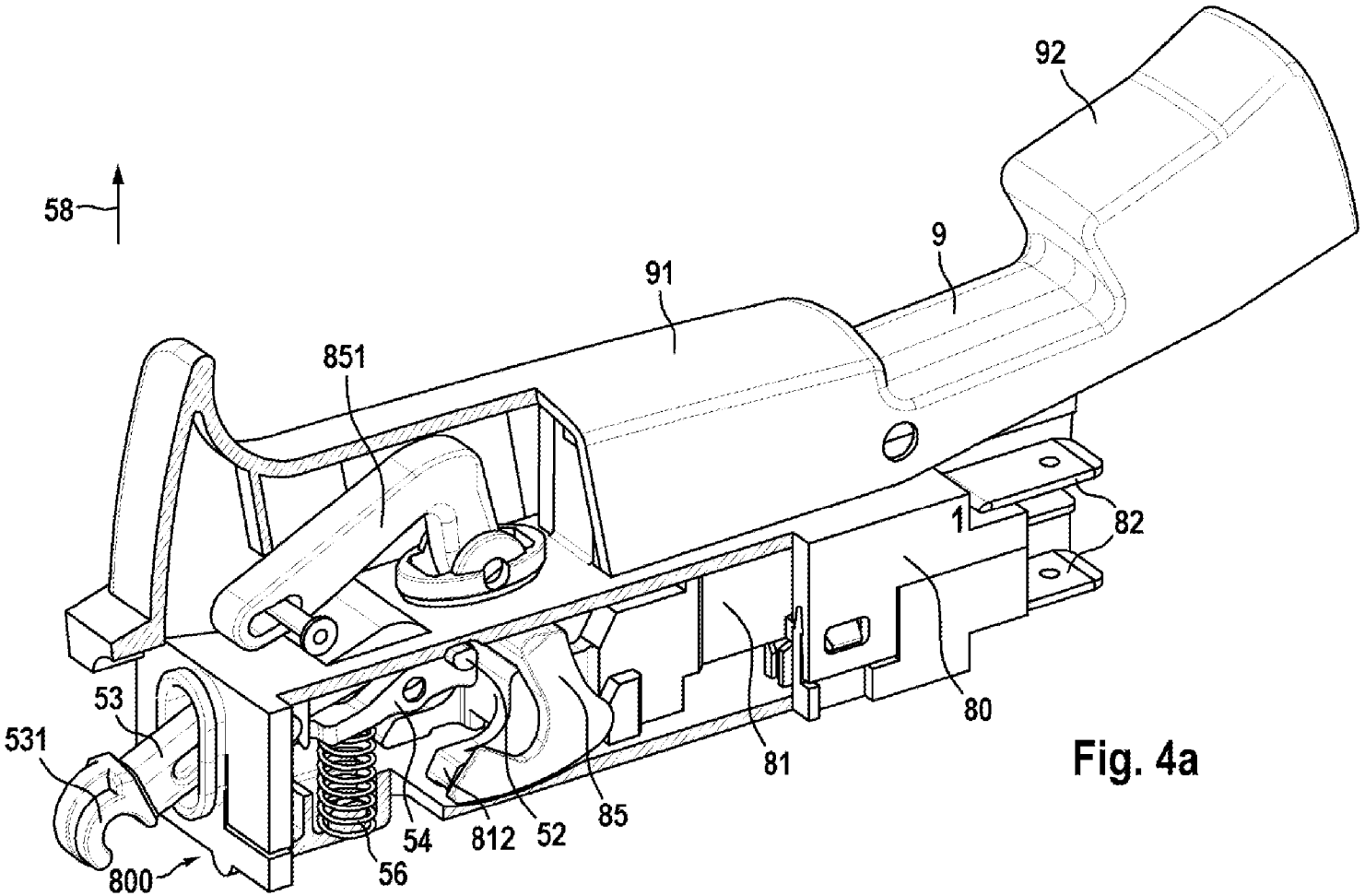
FIG. 4 illustrates in FIGS. 4 (*a*)-(*c*) the electric switch shown in FIG. 3, wherein the first switching device is located in the switched-on mode and the second switching device is located in the initial mode.
Figure 4B:
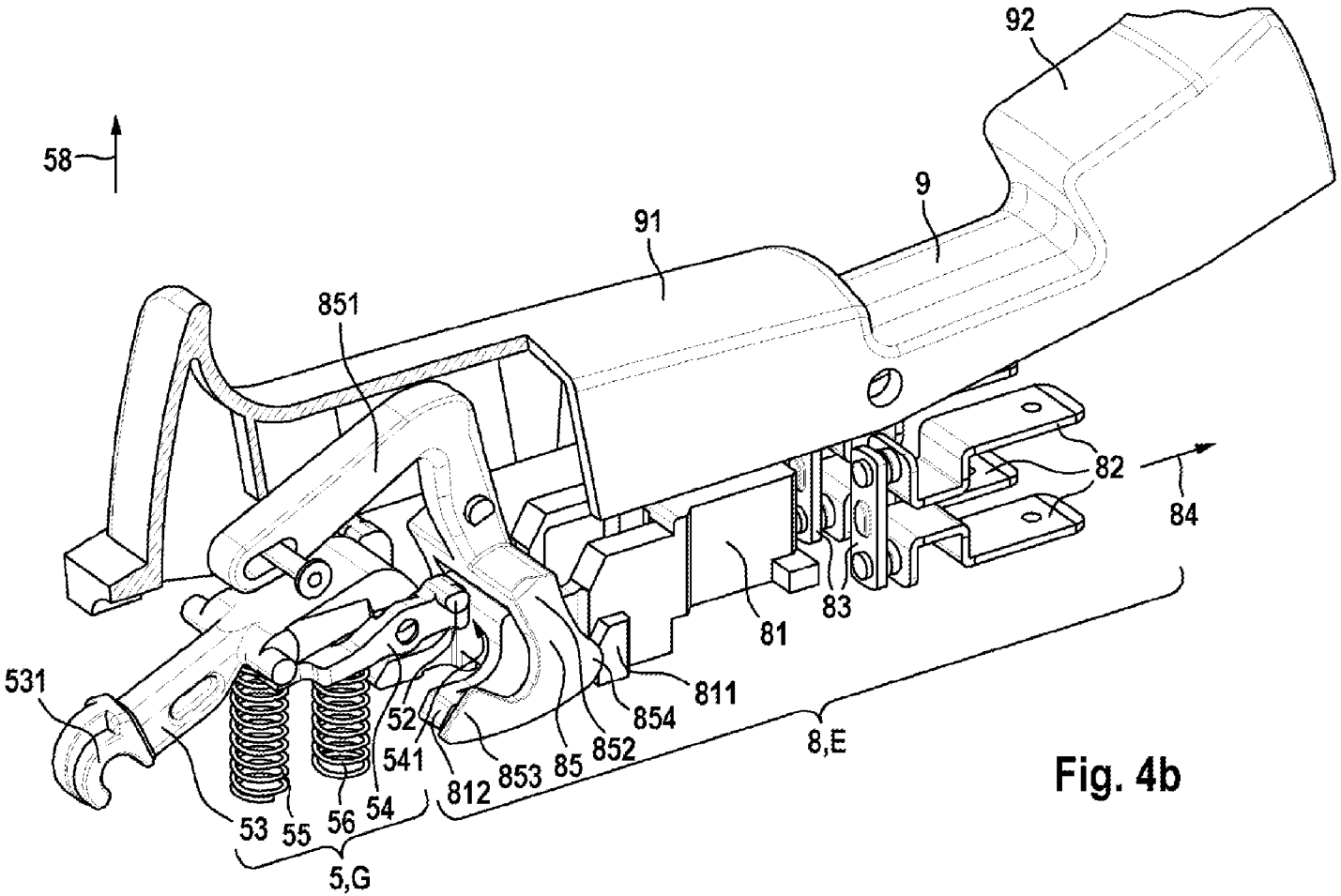
Figure 4C:
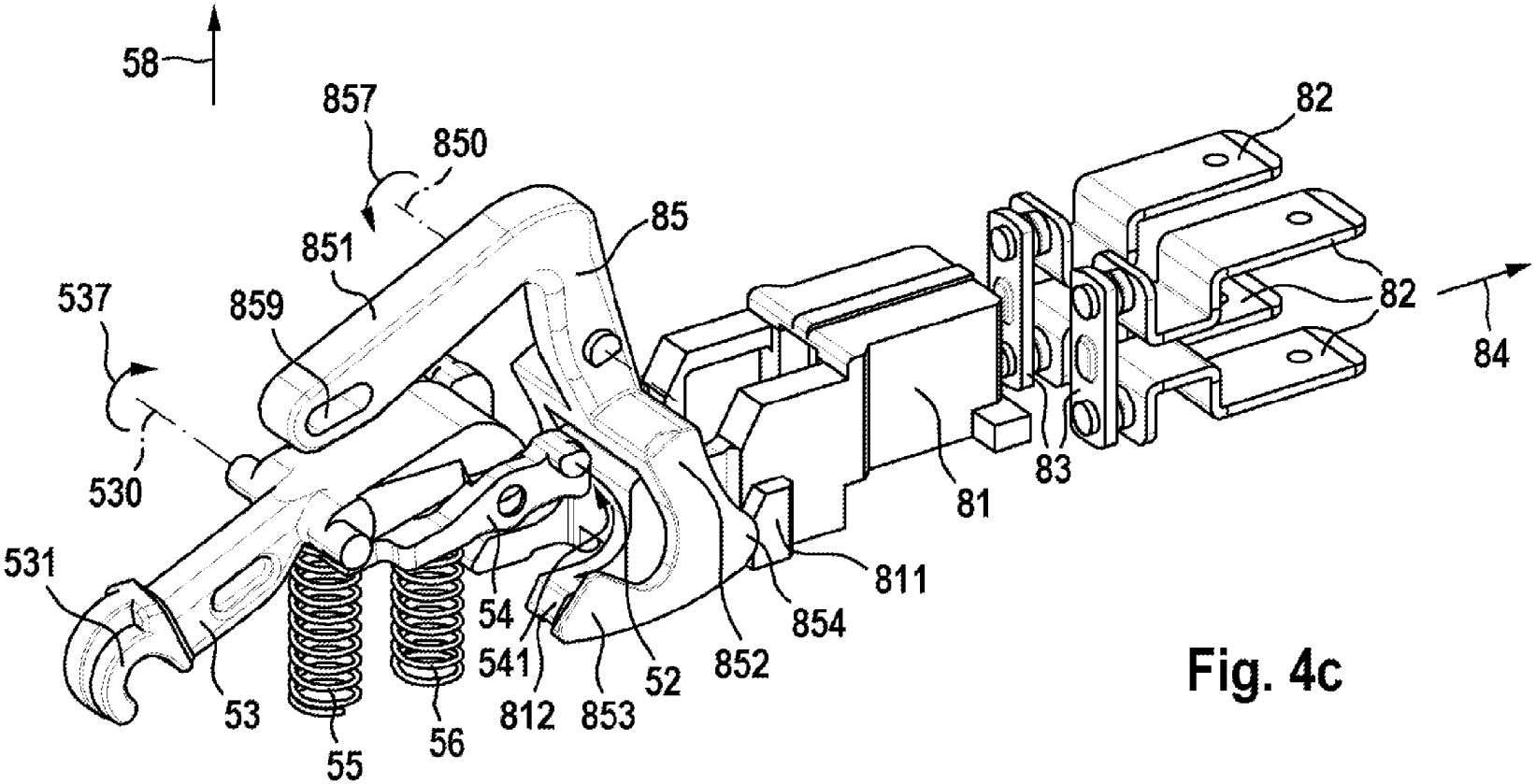

FIG. 4 illustrates in FIGS. 4 (*a*)-(*c*) the operating switch 800 shown in FIG. 3, wherein the first switching device 8 of the operating switch 800 is located in the switched-on mode E and the second switching device 5 is located in the initial mode G.

On account of the restoring force of the first force means, the sliding means 81 in the initial mode G is displaced in the opposite direction to the sliding direction 84 as the rocker switch 9 is released, wherein the electric contacts 83 are displaced in the opposite direction to the sliding direction 84, so that said electrical contacts are displaced away from the electrical connections 82 and the motor current circuit is open. In this case, the part 854 of the angled lever 85 that is remote from the rocker switch 9 is displaced by means of the contacting means 811 of the sliding means 81 in the opposite direction to the sliding direction 84, wherein the angled lever 85 is rotated in the opposite direction to the angled lever direction 857 and wherein the rocker switch 9 is rotated in the opposite direction to the actuating direction 907. As a consequence, the operating switch 800 is returned from the switched-on position E to the switched-off position A.

It is evident from both FIG. 3 and FIG. 4, that, by adjusting the first switching device 8 from the switched-off mode A into the switched-on mode E and the reverse, the angled lever 85 can be rotated freely about the angled lever axis of rotation 85, if the second switching device 5 is located in the initial mode G. In the initial mode G, the operating switch 800 therefore cannot be locked or is locked either in the switched-on mode E or in the switched-off mode A.

In the embodiment illustrated in this case, the operating switch 800 therefore always functions in the initial mode G as a push button.

Figure 5A:
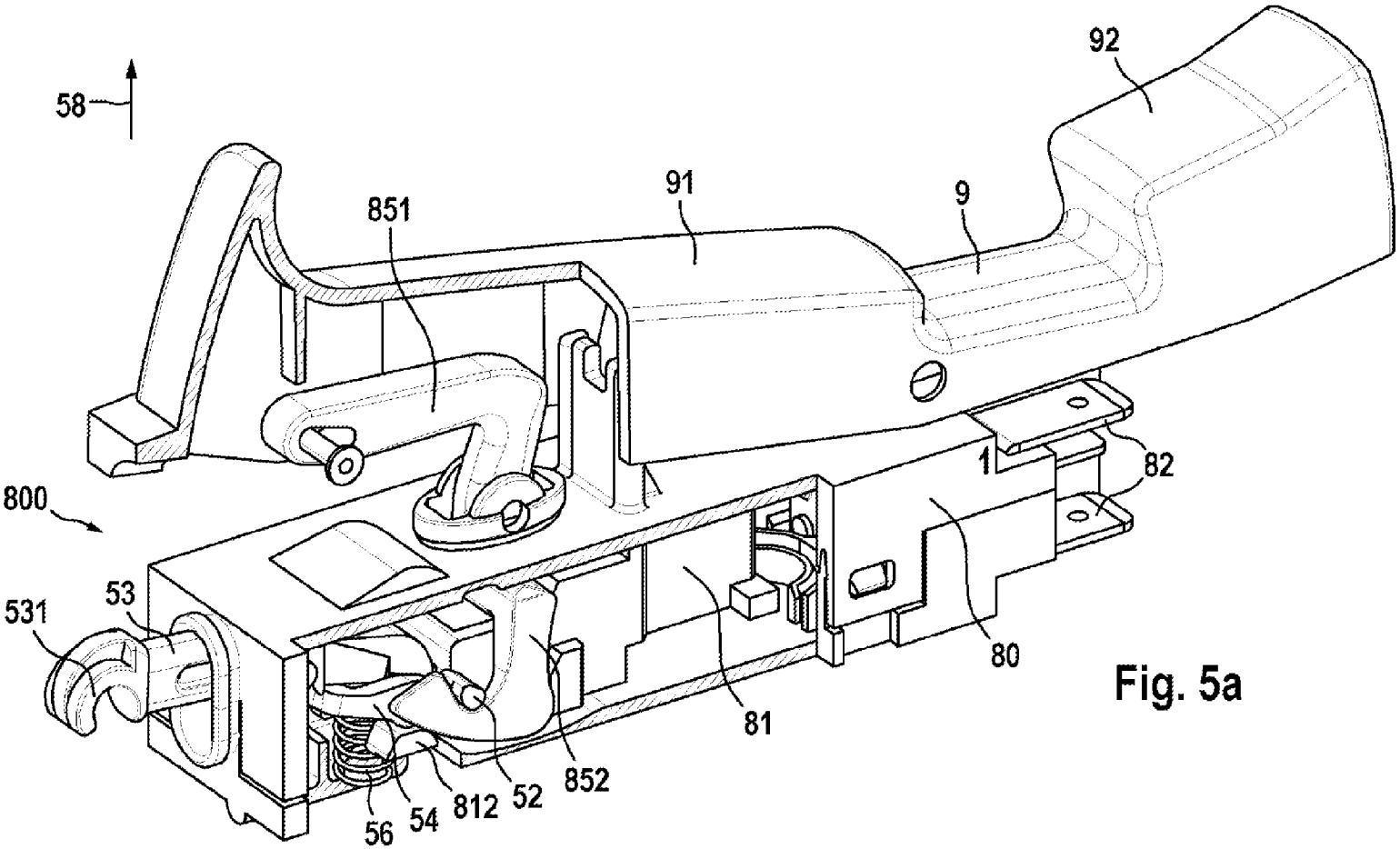
FIG. 5 illustrates in FIGS. 5 (*a*)-(*c*) the electric switch shown in FIG. 3, wherein the first switching device is located in the switched-off mode and the second switching device is located in the locked mode.
Figure 5B:
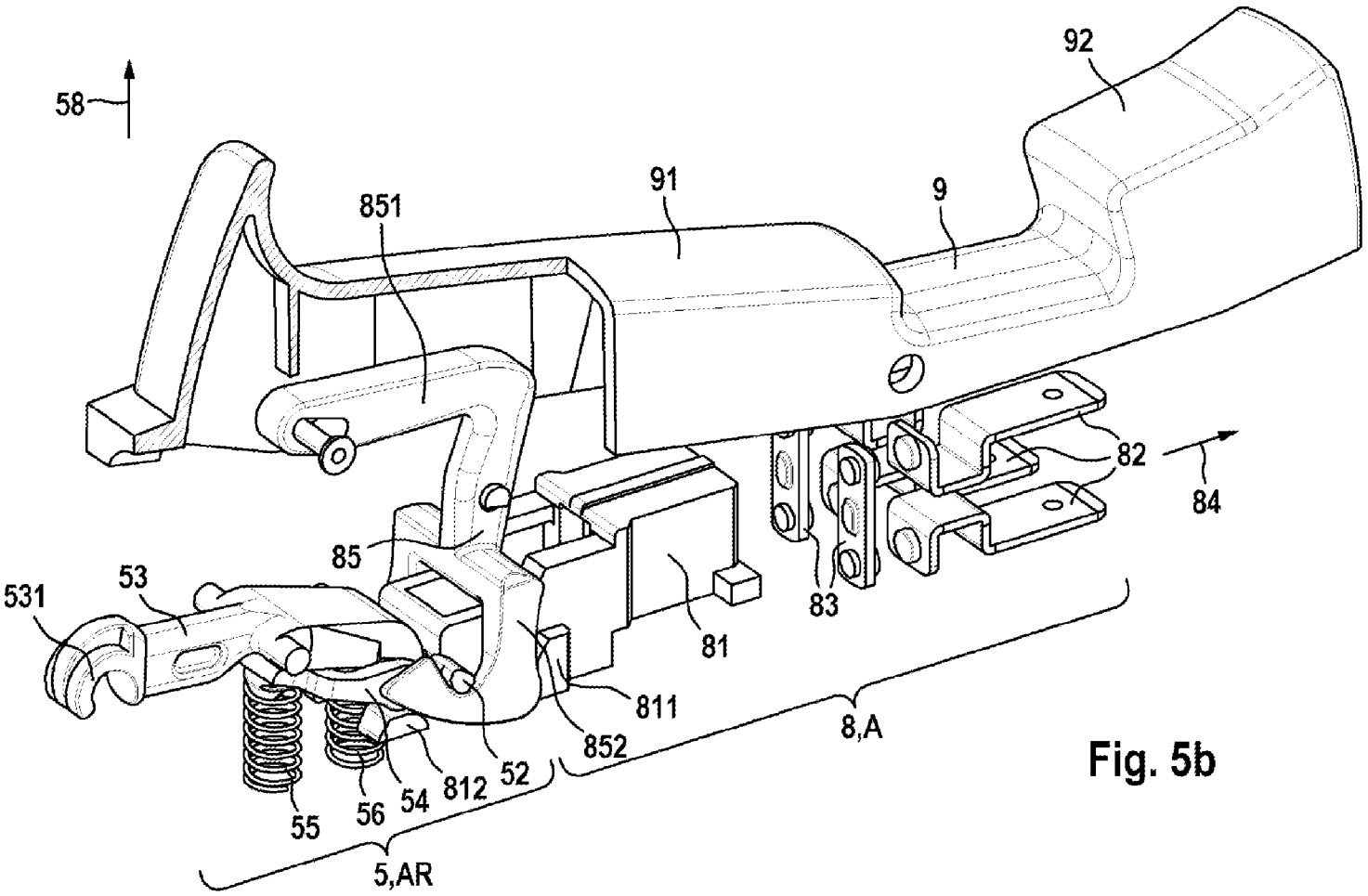
Figure 5C:
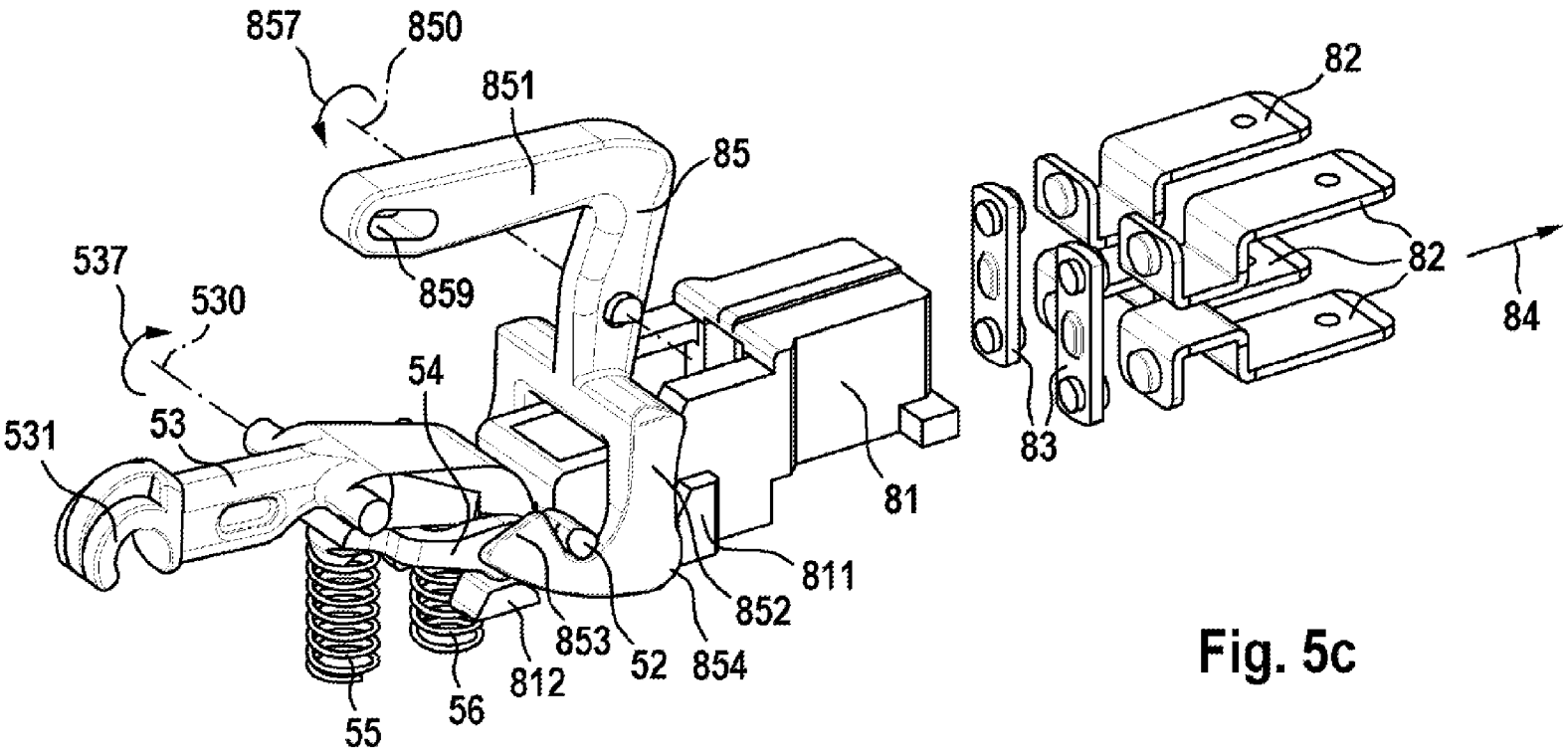

FIG. 5 illustrates in FIGS. 5 (*a*)-(*c*) the operating switch 800 shown in FIG. 3, wherein the first switching device 8 of the operating switch 800 is located in the switched-off mode A and the second switching device 5 is located in the locked mode AR.

The second switching device 5 comprises a second adjusting means 54 that is embodied in this case as a locking latch and is mounted on the switching lever 53 in such a manner as to be able to rotate about a locking latch axis 540. Within the framework of FIGS. 3-6, the terms "second adjusting means 54" and "locking latch" are used synonymously.

The switching lever 53 is mounted on the switch housing 80 of the operating switch 800 in such a manner as to be able to rotate about a switching lever axis 530. As the operating mode is adjusted from the "drilling operation" or "hammer drill operation" into the "chipping operation", the second switching device 5 is adjusted from the initial mode G into the locked mode AR, in that the switching lever 53 is rotated in a switching lever direction 537 about the switching lever axis 530 against the force 58 of the second force means that is embodied in this case as a compression spring. Since the locking latch 54 is mounted on the switching lever 53, said locking latch co-rotates with the switching lever 53.

A raising means 52 that is embodied in this case as a lug is arranged on the locking latch 54. Within the framework of FIGS. 3-6, the terms "raising means 52" and "lug" are used synonymously. The lug 52 is arranged on the face of the locking latch 54 that faces the arcuate extension 852. The locking latch 54 is pushed on its face remote from the arcuate extension 852 by means of a compression spring 55 against the switching lever 53.

As the second switching device 5 is adjusted from the initial mode G into the locked mode AR, the locking latch 54 is co-rotated with the switching lever 53 until the lug 52 is arranged in the switched-off mode A of the first switching device 8 in the arcuate region of the arcuate extension 852.

As the first switching device 8 is adjusted from the switched-off mode A into the switched-on mode E, the angled lever 85 is rotated about the angled lever axis 850 in the angled lever direction 857, wherein the arcuate extension 852 is also rotated in the angled lever direction 857 and on account of its arcuate shape it slides along the lug 52, without being hindered by said lug, until the locking latch 54 lies with an end surface 541 (cf. FIGS. 4(*b*), (*c*)) that faces the first switching device 8 against a locking means 812 of the first switching device 8. The compression spring 55 urges the end surface 541 of the locking latch 54 in this case against the locking means 812 of the switching slider 81. In this locked mode AR, the switching slider 81 cannot be displaced by means of the force of the force means back in the opposite direction to the sliding direction 84.

Figure 6A:
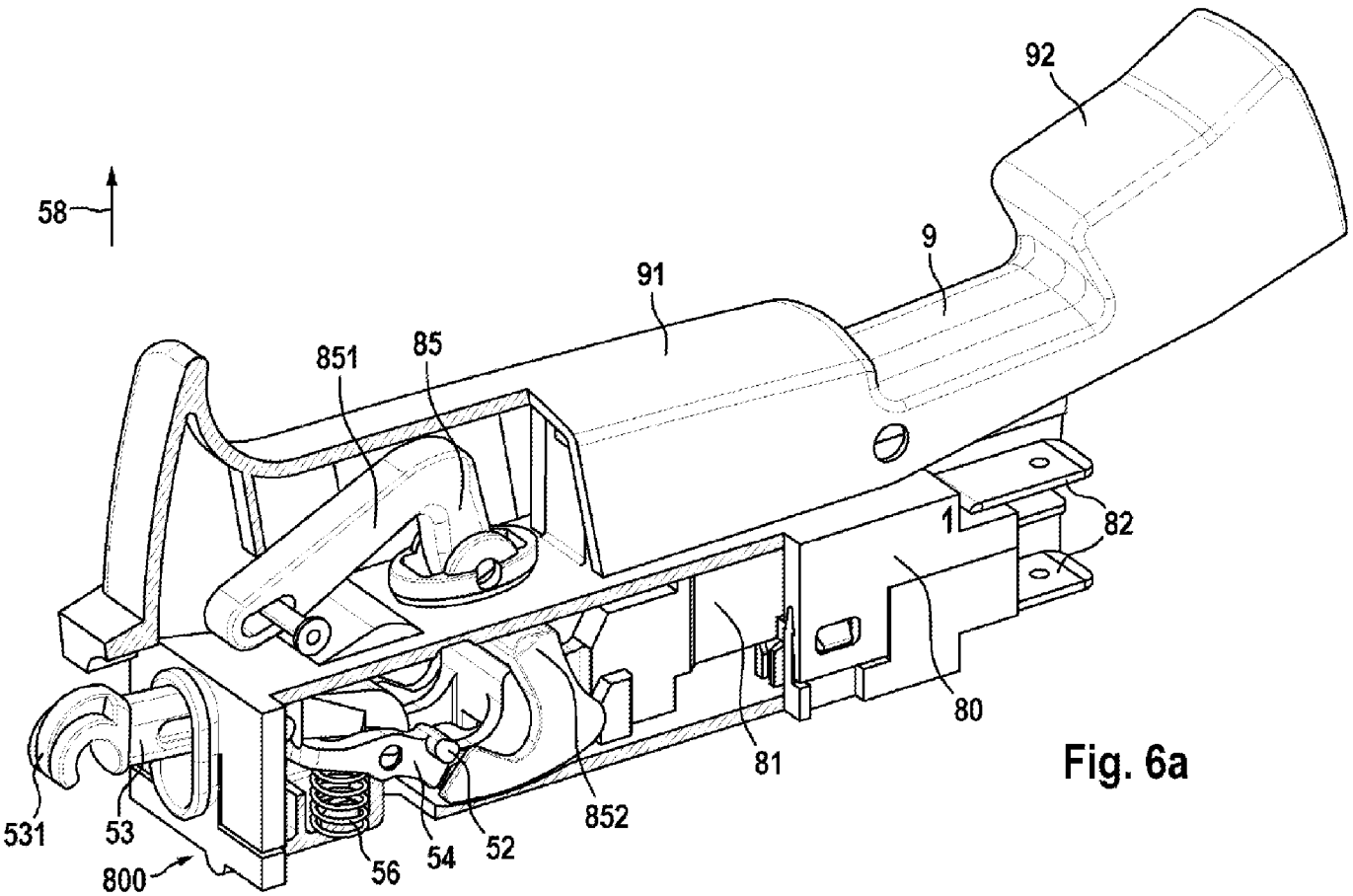
FIG. 6 illustrates in FIGS. 6 (*a*)-(*c*) the electric switch shown in FIG. 3, wherein the first switching device is located in the switched-on mode and the second switching device is located in the locked mode.
Figure 6B:
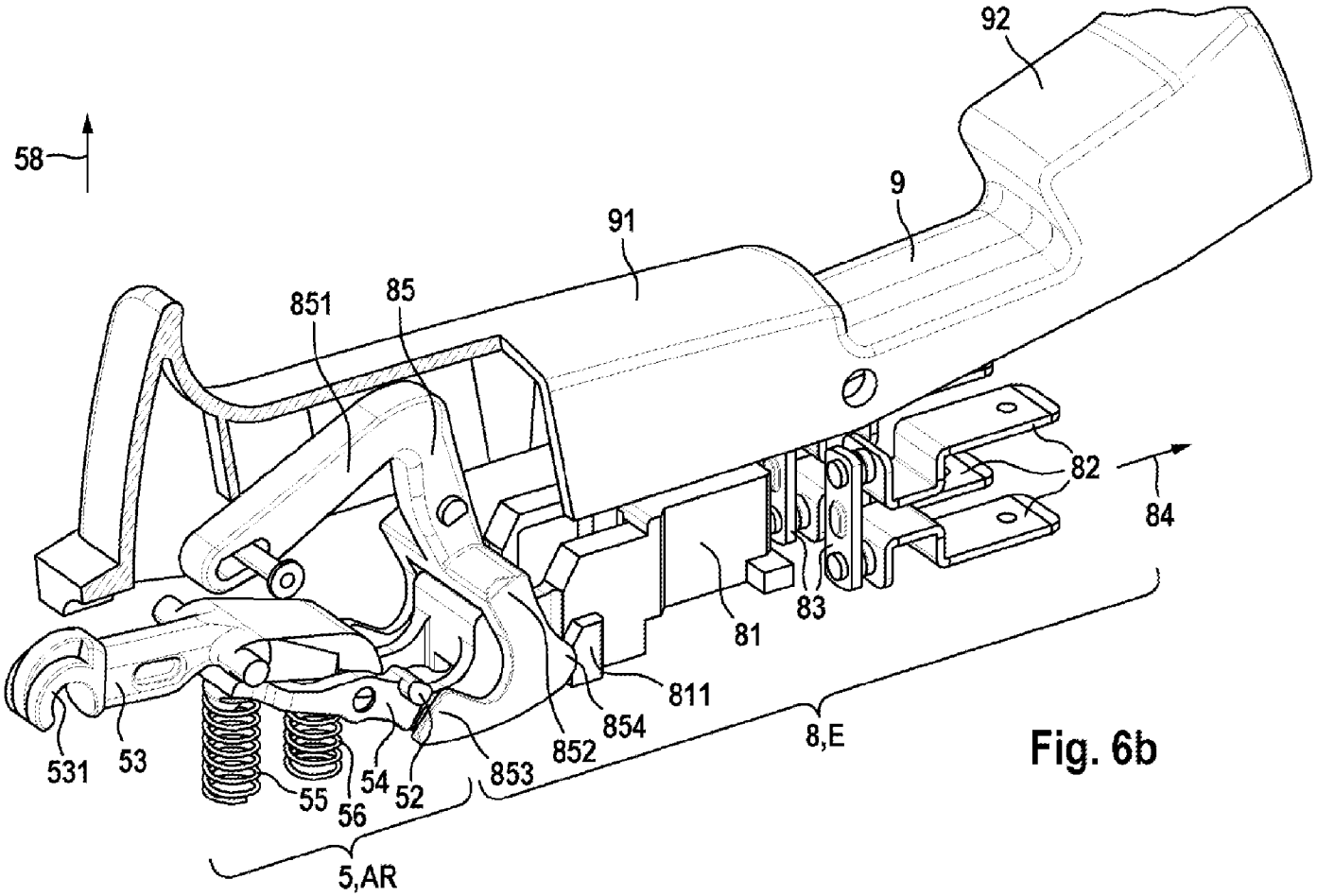
Figure 6C:
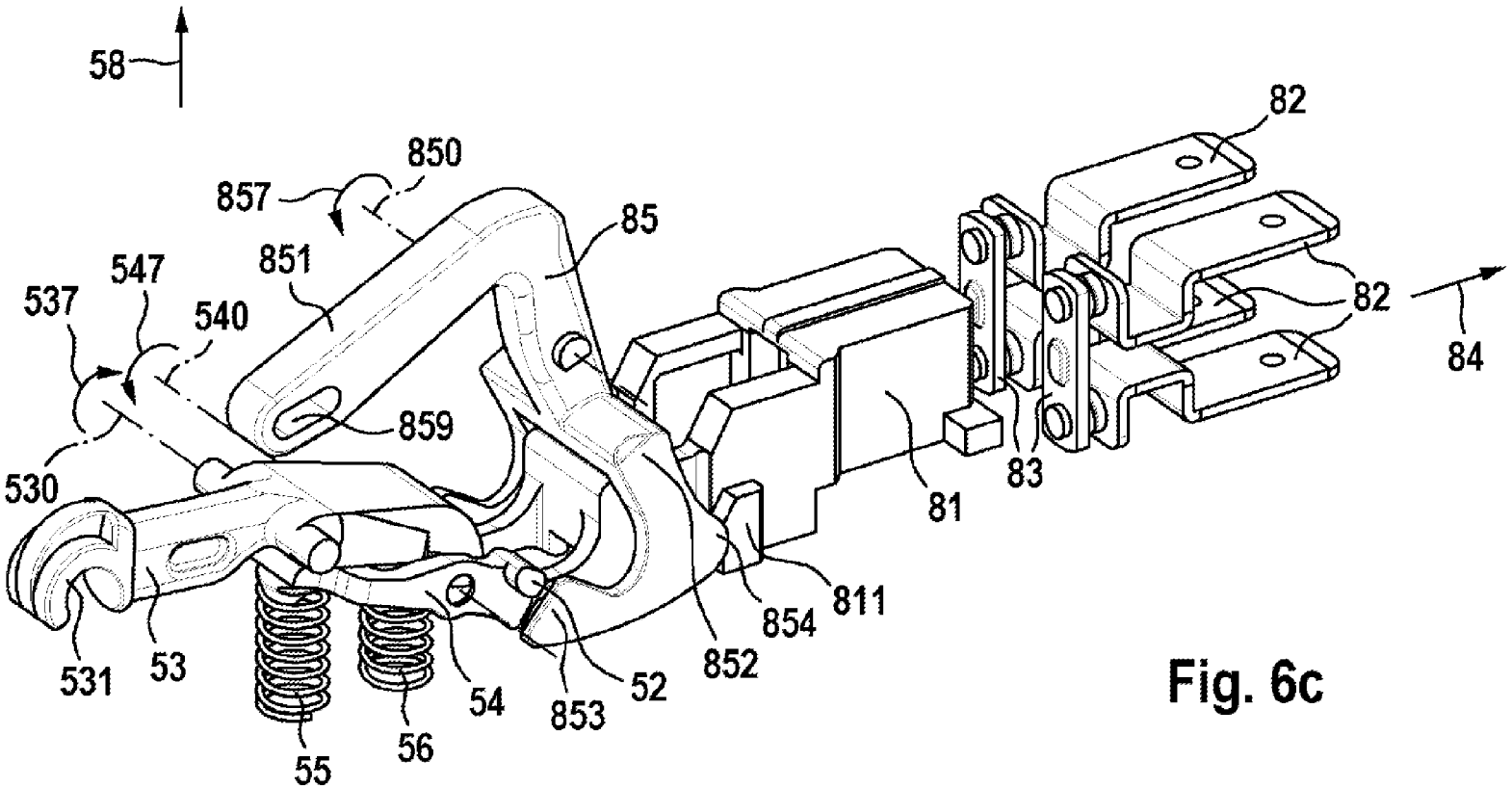

FIG. 6 illustrates in FIGS. 6 (*a*)-(*c*) the operating switch 800 shown in FIG. 3, wherein the first switching device 8 of the operating switch 800 is located in the switched-on mode E and the second switching device 5 is located in the locked mode AR.

As the rocker switch 9 is released, the sliding means 81 is pushed or pulled in the opposite direction to the sliding direction 84 on account of the restoring force of the first force means. Since the contacting means 811 of the sliding means 81 lies against the end 854 of the arcuate extension 852 that is remote from the second switching device 5, the angled lever 85 in this case can be pushed back. However, since the end surface 541 of the locking latch lies against the locking means 812 of the first switching device 8, the sliding means 81 cannot be pushed back in the opposite direction to the sliding direction 84. At the same time, the arcuate extension 852 of the angled lever 85 then lies with its end 853 that is facing the second switching device 5 on the lug 52, so that said angled lever cannot be rotated back into the previous position.

In contrast thereto, by means of depressing the second rocker switch part 92, the angled lever 85 is rotated about the angled lever axis 850 in the opposite direction to the angled lever direction 857 by means of sufficient force being applied by the operator. In this case, the end 853 of the arcuate extension 852 that faces the second switching device 5 raises the raising means 52 so that the locking latch 54 rotates about the locking latch axis 540 in a release direction and the end face 541 of the locking latch 54 is raised from the locking means 812. In so doing, the compression spring 55 is initially compressed against its restoring force. The raising means 52 then slides along the arcuate extension 852 until said raising means is arranged in the switched-off mode A of the first switching device 8 back in the arcuate region of the arcuate extension 852, wherein the stress in the compression spring 55 is at least partially relieved.

On account of the restoring force of the first force means, the sliding means 81 is displaced in the opposite direction to the sliding direction 84, so that the motor current circuit is open. In this case, the part 854 of the angled lever 85 that is remote from the rocker switch 9 is displaced by means of the contacting means 811 of the sliding means 81 in the opposite direction to the sliding direction 84, wherein the angled lever 85 is rotated in the opposite direction to the angled lever direction 857. As a consequence, the operating switch 800 is returned from the switched-on position E into the switched-off position A.

The first switching device 8 of the operating switch 800 is then located back in the switched-off mode A, wherein the second switching device 5 is located in the locked mode AR (cf. FIG. 5).

In the locked mode AR, the operating switch 800 can therefore be locked in the switched-off mode A, wherein said operating switch is adjusted into the switched-on mode E. In the switched-on mode E, however, said operating switch is, in contrast thereto, locked by means of the second switching device 5. The operating switch 800 therefore functions in the locked mode AR as a rocker switch.

In addition, the operating switch 800 can be adjusted only in the locked mode AR by means of actuating the second rocker switch part 92 from the switched-on mode E into the switched-off mode A. In the initial mode G in which the operating switch 800 functions as a push button, the rocker switch 9 is, in contrast, automatically rotated back about the rocker switch axis 90 in the opposite direction to the actuating direction 907 as the first switching device 8 is returned to its previous position (cf. FIG. 4).

As the operating switch is returned from the "chipping operation" into the "drilling operation" or "hammer drill operation", the switching lever 53 is rotated about the switching lever axis 530 in the opposite direction to the switching lever direction 537 on account of the restoring force of the second force means 56, wherein the band 6 is returned to its previous position. Since the switching latch 54 is mounted on the switching lever 53, said switching latch co-rotates with the switching lever 53.

In this case, the end face 541 of the locking latch 54 rotates about the locking latch axis 540, wherein said end face rotates away from the locking means 812 of the sliding means 81 and in fact irrespectively of whether the first switching device 8 is located in the switched-on mode E or in the switched-off mode A. Based on the switched-off mode E, it is effected that by rotating the end face 541 away from the locking means 812 the sliding means 81 is displaced in the opposite direction to the sliding direction 84 on account of the restoring force of the first force means, wherein the angled lever 85 is rotated in the opposite direction to the angled lever direction 857, wherein the rocker switch 9 is rotated in the opposite direction to the rocker switch direction 907 and wherein the first switching device 8 is adjusted into the switched-off mode A. The second switching device 5 is then located in the initial mode G.

The invention claimed is:

1. An electric switch for an electric power tool, comprising:

a first switching device configured to be reversibly adjusted by adjusting a first mechanical signal mechanism from a first switching mode into a second switching mode; and a second switching device configured to be reversibly adjusted by adjusting a second signal mechanism from a third switching mode, in which the electric switch functions as a push button, into a fourth switching mode, in which the electric switch functions as a rocker switch, the second switching device including a second adjusting mechanism that cooperates with the second signal mechanism, wherein the second signal mechanism is one of an electrical signal device and a mechanical signal device, wherein the first switching mode is a switched-on mode in which the electric switch closes a current circuit, wherein the second switching mode is a switched-off mode in which the current circuit is open, wherein the third switching mode is an initial mode in which the first signal mechanism cannot be locked, and wherein the fourth switching mode is a locked mode of the electric switch in which the first signal mechanism is (i) configured to be locked by the second adjusting mechanism if the first signal mechanism is in the switched-off mode and (ii) locked by the second adjusting mechanism if the first signal mechanism is in the switched-on mode.

2. The electric switch as claimed in claim 1, wherein the first switching device includes an electrical contact and electrical connections configured for closing the current circuit.

3. The electric switch as claimed in claim 2, wherein:

the first switching device includes a first adjusting mechanism, which cooperates with the first signal mechanism, and the electrical contact is adjusted by the first adjusting mechanism.

4. The electric switch as claimed in claim 3, wherein, in the third switching mode, the first adjusting mechanism cannot be locked.

5. The electric switch as claimed in claim 4, wherein, in the fourth switching mode, the first adjusting mechanism is (i) configured to be locked by the second adjusting mechanism if the first adjusting device is in the switched-off mode and (ii) locked by the second adjusting mechanism if the first adjusting device is in the switched-on mode.

6. The electric switch as claimed in claim 5, wherein:

the first switching device is configured to be adjusted against a first force of a first force means from the switched-off mode into the switched-on mode, and the second switching device is configured to be adjusted against a second force of a second force means from the initial mode into the locked mode.

7. The electric switch as claimed in claim 1, further comprising:

a first actuating mechanism configured for actuating the first signal mechanism; and a second actuating mechanism configured for actuating the second signal mechanism.

8. The electric switch as claimed in claim 1, further comprising:

a second actuating mechanism configured for actuating the second signal mechanism, wherein at least one of the second adjusting mechanism and the second actuating mechanism is embodied in a mechanical or electrical manner.

9. The electric switch as claimed in claim 1, wherein said electric switch comprises a housing.

10. The electric switch as claimed in claim 1, wherein the current circuit is a motor current circuit configured to drive the electric power tool.

11. An electric power tool, comprising:

an electric switch having a first switching device and a second switching device, wherein the first switching device is reversibly adjusted by adjusting a first mechanical signal mechanism from a first switching mode into a second switching mode, wherein the second switching device is reversibly adjusted by adjusting a second signal mechanism from a third switching mode in which the electric switch functions as a push button into a fourth switching mode in which the electric switch functions as a rocker switch, the second switching device including a second adjusting mechanism that cooperates with the second signal mechanism, wherein the second signal mechanism is one of an electrical signal device and a mechanical signal device, wherein the first switching mode is a switched-on mode in which the electric switch closes a current circuit, wherein the second switching mode is a switched-off mode in which the current circuit is open, wherein the third switching mode is an initial mode in which the first signal mechanism cannot be locked, and wherein the fourth switching mode is a locked mode of the electric switch in which the first signal mechanism is (i) configured to be locked by the second adjusting mechanism if the first signal mechanism is in the switched-off mode and (ii) locked by the second adjusting mechanism if the first signal mechanism is in the switched-on mode.

12. The electric power tool as claimed in claim 11, further comprising:

a hand grip housing;

an operating mode switch; and a tool housing, wherein the electric switch further includes (i) a first actuating mechanism configured for actuating the first signal mechanism and (ii) a second actuating mechanism configured for actuating the second signal mechanism, wherein the electric switch and the first actuating mechanism are supported in the hand grip housing, and wherein the operating mode switch is configured for adjusting the second actuating mechanism that is arranged in the tool housing.

13. The electric switch of claim 12, wherein the hand grip housing is an anti-vibration hand grip housing.

14. The electric switch of claim 11, wherein the electric power tool is a chisel hammer.

15. An electric switch for an electric power tool, comprising:

a first switching device configured to be reversibly adjusted by adjusting a first mechanical signal mechanism from a first position into a second position; and a second switching device configured to be reversibly adjusted by adjusting a second signal mechanism from a third position into a fourth position, the second switching device including a second adjusting mechanism that cooperates with the second signal mechanism to selectively block the first signal mechanism, wherein the electric switch (i) closes a current circuit when the first signal mechanism is in the first position and (ii) opens the current circuit when the first signal mechanism is in the second position, wherein the second adjusting mechanism is reversibly adjusted via the second signal mechanism from a fifth position into a sixth position, wherein, when the second adjusting mechanism is in the fifth position and the first signal mechanism is in the first position, the second adjusting mechanism does not block the first signal mechanism from returning to the second position such that the electric switch functions as a push button, and wherein, when the second adjusting mechanism is in the sixth position and the first signal mechanism is in the first position, the second adjusting mechanism blocks the first signal mechanism from returning to the second position such that the electric switch functions as a rocker switch.

* * * * *